US005850121A

United States Patent [19]

Matsudate

[11] Patent Number: 5,850,121

[45] Date of Patent: Dec. 15, 1998

[54] COLOR PICTURE TUBE HAVING SHADOW MASK ASSEMBLY

[75] Inventor: Noriharu Matsudate, Chiba-ken, Japan

[73] Assignee: Hitachi, Ltd., Tokyo, Japan

[21] Appl. No.: 773,415

[22] Filed: Dec. 27, 1996

Related U.S. Application Data

[63] Continuation-in-part of Ser. No. 528,522, Sep. 15, 1995, abandoned.

[30] Foreign Application Priority Data

Sep. 16, 1994 [JP] Japan ..... 6-222032

[51] Int. Cl.[6] ..... H01J 29/07

[52] U.S. Cl. ..... 313/402; 313/407

[58] Field of Search ..... 313/402, 407; 252/513, 512, 519

[56] References Cited

U.S. PATENT DOCUMENTS

| | | | |
|---|---|---|---|
| 4,698,545 | 10/1987 | Inaba et al. | 313/407 X |
| 4,716,334 | 12/1987 | Fendley et al. | 313/407 |
| 4,748,370 | 5/1988 | Van Denbroek | 313/407 X |
| 4,827,178 | 5/1989 | Higashinakagawa et al. | 313/407 X |
| 4,827,180 | 5/1989 | Sone et al. | 313/407 X |
| 5,347,195 | 9/1994 | Seo | 313/407 X |
| 5,394,052 | 2/1995 | Oh | 313/407 X |

*Primary Examiner*—Ashok Patel

*Attorney, Agent, or Firm*—Antonelli, Terry, Stout & Kraus, LLP

[57] ABSTRACT

A shadow mask assembly 1 includes a shadow mask 2 of invariable curvature and rotatable by a minimum required amount when the ambient temperature changes. The shadow mask assembly includes a shadow mask 2 having a number of electron beam apertures, a support frame 3 for holding the shadow mask 2, and mask springs 4 for holding the support frame 3 inside a panel of a color picture tube, wherein the shadow mask 2 is made of a metal material composed chiefly of invar, and the support frame 3 and the mask springs 4 are made of low-expansion stainless steel or metal material having a coefficient of thermal expansion of not larger than $1.19\times10^{-5}$ such as stainless steel whose chromium content is 11% to 16% by weight. In the shadow mask assembly 1 using such metal materials, the curvature at the peripheral edges of the shadow mask 2 does not locally change during the fabrication. A color picture tube provided with the shadow mask assembly 1 does not suffer excessive angular displacement with a change in the ambient temperature.

20 Claims, 5 Drawing Sheets

FIG. 2

| | This embodiment | Prior art |
|---|---|---|
| Shadow mask | invar ($6.89 \times 10^{-6}$) | invar ($6.89 \times 10^{-6}$) |
| Support frame | low-expansion stainless steel ($1.04 \times 10^{-5}$) | Aluminum-killed (AK) material (low carbon) ($1.32 \times 10^{-5}$) |
| Mask springs | low-expansion stainless steel ($1.19 \times 10^{-5}$) | bimetal (stainless steel/invar) ($1.5 \times 10^{-5}/1.0 \times 10^{-5}$) |

Purity drift characteristics

Environmental temperature characteristics

Moving direction of electron beam landing

COLOR PICTURE TUBE HAVING SHADOW MASK ASSEMBLY

This application is a Continuation-in-part application Ser. No. 08/528,522, filed Sep. 15, 1995, now abandoned the contents of which are incorporated herein by reference in their entirety.

BACKGROUND OF THE INVENTION

The present invention relates to a shadow mask assembly used for a color picture tube. More specifically, the invention relates to a shadow mask assembly that reduces thermal deformation on its curved surface appearing in the step of producing color picture tubes and involves less beam landing error that accompanies the turn of the mask caused by a rise in the temperature during the operation.

A shadow mask assembly used for a color picture tube usually comprises a shadow mask having a number of electron beam apertures, a support frame for holding the shadow mask, and mask springs which hold the support frame inside the panel of a color picture tube. In the shadow mask assembly, the shadow mask is made of, for example, invar (having a coefficient of thermal expansion of, for example, $6.89\times10^{-6}$), the support frame is made of an aluminum-killed (AK) material containing a small amount of carbon (having a coefficient of thermal expansion of, for example, $1.32\times10^{-5}$), and the mask springs are made of a bimetal of a stainless steel (having a coefficient of thermal expansion of, for example, $1.5\times10^{-5}$) lined with invar (having a coefficient of thermal expansion of, for example, $1.0\times10^{-5}$).

The reason why the mask springs made of a bimetal are used for holding the support frame inside the panel of the color picture tube is to balance the purity drift and the environmental temperature drift; i.e., the shadow mask assembly turns by a very small angle on the tubular axis by utilizing the warping of the bimetal accompanying a change in the temperature, in order to bring the positions of the electron beam apertures of the shadow mask into alignment with the positions at which the electron beams are passing through.

In the above-mentioned known shadow mask assembly, four peripheral edges of the shadow mask are welded to the edge portion of the support frame, so that the shadow mask is firmly held by the support frame.

In this case, the metal material (e.g., invar) constituting the shadow mask is very different in coefficient of thermal expansion from the metal material (e.g., AK material or low-carbon steel) constituting the support frame, and the shadow mask which is thermally expanded little is welded onto the support frame which is thermally expanded to a large degree. Then, as the support frame is no longer heated and is allowed to contract to the initial state, the peripheral surfaces of the shadow mask contract and, particularly, the peripheral surfaces on the side of short edges contract accompanying the contraction of the support frame, whereby the curvature of the shadow mask changes and beam landing error occurs on the portions where the curvature has changed.

The above-mentioned shadow mask assembly includes the mask springs of a bimetal. When the ambient temperature rises during operation, therefore, the shadow mask assembly is excessively turned on the tubular axis of the color picture tube, resulting in the occurrence of beam landing error.

The present invention removes the above-mentioned problems, and its object is to provide a shadow mask assembly which turns to a required minimum degree accompanying a change in the ambient temperature without permitting the curvature of the shadow mask to change.

SUMMARY OF THE INVENTION

In order to accomplish the above-mentioned object, the present invention provides a shadow mask assembly comprising a shadow mask having a number of electron beam apertures, a support frame for holding the shadow mask, and mask springs for holding the support frame inside a panel of a color picture tube, wherein the shadow mask is made of a metal material composed chiefly of invar, and the support frame and the mask springs are made of stainless steel having coefficients of thermal expansion (coefficient of thermal expansion means coefficient of linear expansion) smaller than a coefficient of thermal expansion of a low-carbon steel.

As another means, the shadow mask is made of a metal material composed chiefly of invar, and the support frame and the mask springs are made of metal materials having coefficients of thermal expansion of not larger than $1.19\times10^{-5}$.

As a further means, the shadow mask is made of a metal material composed chiefly of invar, and the support frame is made of stainless steel which has a nickel content of equal or less than 10% by weight.

As a further means, the shadow mask is made of a metal material composed chiefly of invar, and the support frame is made of stainless steel which has a nickel content of equal or less than 10% by weight.

As a further means, the shadow mask is made of a metal material composed chiefly of invar, and the support frame and the mask springs are made of metal materials having a chromium content of 11 to 16% by weight.

According to the above-mentioned means, the support frame is not abnormally subjected to thermal expansion in the process of producing a color picture tube, the curvature of the shadow mask does not locally change, and beam landing error does not occur since the curvature of the shadow mask does not change.

According to the above-mentioned means, furthermore, the shadow mask assembly does not excessively turn with a rise in the ambient temperature, and thus beam landing error decreases.

BRIEF DESCRIPTION OF THE DRAWINGS

FIG. 2 is a diagram comparing the materials constituting the shadow mask, support frame and mask springs between the present invention and a known shadow mask assembly;

DESCRIPTION OF THE PREFERRED EMBODIMENTS

An embodiment of the present invention will now be described in detail with reference to the drawings.

Figure 1A:
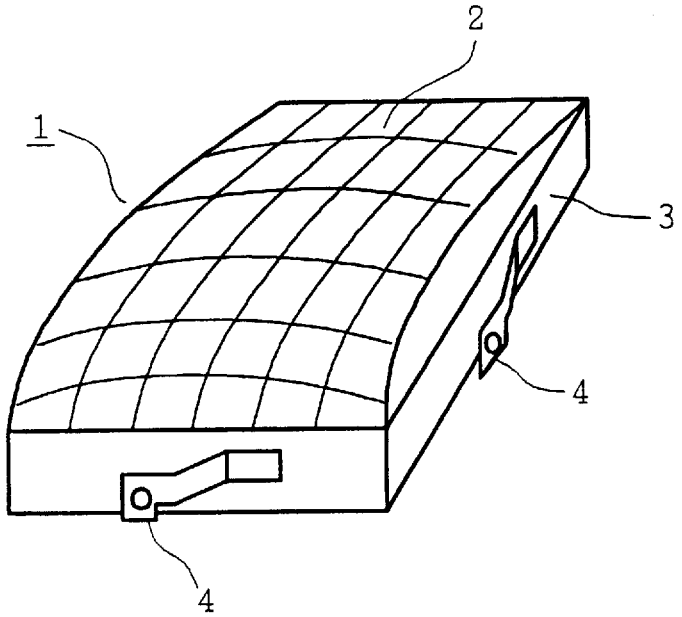
FIG. 1*a* is a perspective view illustrating a shadow mask assembly according to an embodiment of the present invention.
Figure 1B:
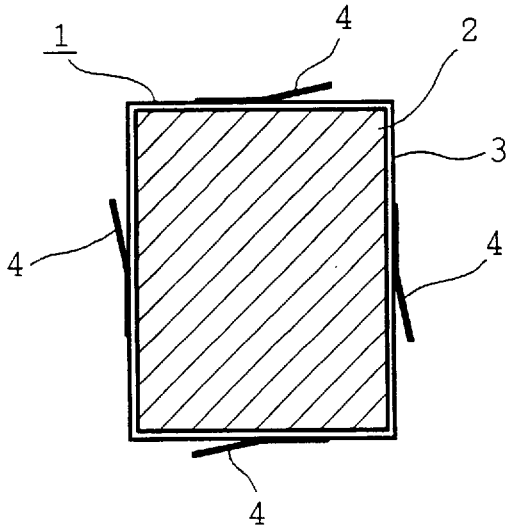
FIG. 1*b* is a top view illustrating the shadow mask assembly according to the embodiment of the present invention.

FIG. 1*a* is a perspective view illustrating the constitution of a shadow mask assembly according to an embodiment of the present invention and FIG. 1*b* is a top view thereof, wherein reference numeral 1 denotes a shadow mask assembly, 2 denotes a shadow mask, 3 denotes a support frame, and reference numeral 4 denotes mask springs which are usually called leaf springs.

The shadow mask 2 has a number of electron beam apertures in a curved plane having a predetermined curvature. It has a domed central apertured portion. The four peripheral edges of the shadow mask 2 are welded to the support frame 3. A mask spring 4 is welded at one side to each of the four sides of the support frame 3. This structure constitutes a shadow mask assembly 1 as a whole.

Figure 6:
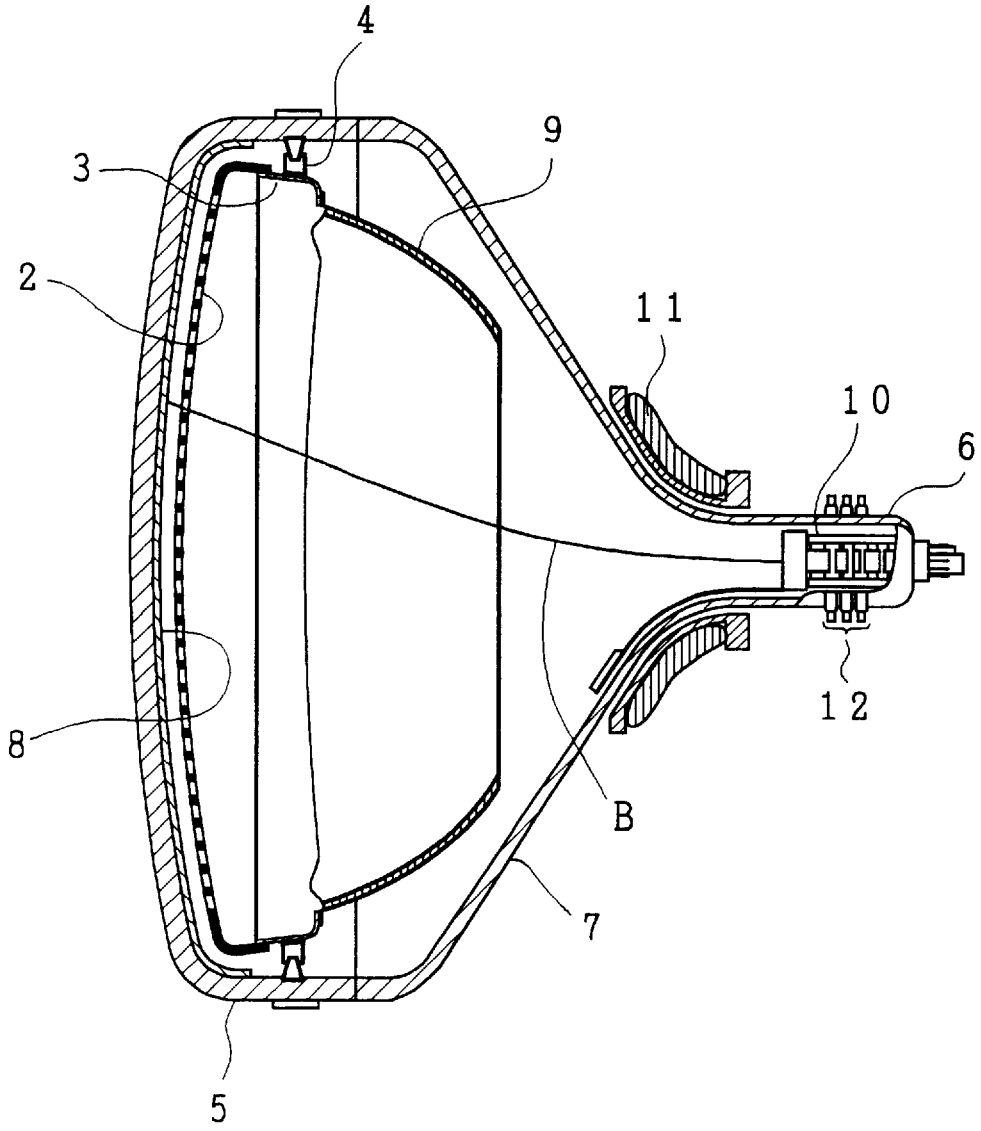
FIG. 6 is a sectional view of a shadow-mask color cathode ray tube (color picture tube) according to the present invention.

FIG. 6 is a sectional view of a shadow-mask color cathode ray tube according to the present invention, wherein reference numeral 5 denotes a panel portion, 6 denotes a neck portion, 7 denotes a funnel portion, 8 denotes a phosphor layer, 9 denotes a magnetic shield, 10 denotes an electron gun, 11 denotes a deflection yoke, 12 denotes a centering and purity correcting magnetic device, and B denotes electron beams.

In FIG. 6. a phosphor layer 8 is made of a three color phosphor mosaic formed on the inner surface of the panel portion 5, and a shadow mask assembly is suspended from the panel pin embedded in the inner wall through the mask spring 4.

The funnel portion 7 has the neck portion 6 for accommodating the electron gun 10 at its small-diameter end and constitutes a vacuum envelope by frit-welding the open margin of the panel 5 to the large-diameter end margin.

The deflection yoke 11 is externally set to the neck transition portion of the funnel and an image is reproduced by two-dimensionally scanning the phosphor layer 8 formed on the inner surface of the panel portion 5 by the electron beam B emitted from the electron gun 10.

The centering and purity correcting magnetic device 12 externally set to the neck portion 6 is correction means for controlling the hue by adjusting the alignment of the electron gun 10 and tube axes and adjusting the mutual arrangement between three electron beams.

The shadow mask 2 has the so-called color selecting function for correctly landing three electron beams B emitted from an electron gun 10 on a three-color phosphor mosaic constituting the phosphor layer 8 respectively.

First Embodiment

In order to accomplish the above-mentioned object, a shadow mask assembly according to this invention comprises a shadow mask having a number of electron beam apertures, a support frame for holding the shadow mask, and mask springs for holding the support frame inside a panel of a color picture tube, wherein the shadow mask is made of a metal material composed chiefly of invar, and the support frame and the mask springs are made of stainless steel having coefficients of thermal expansion smaller than a coefficient of thermal expansion of a low-carbon steel.

Moreover, the bimetal mask springs are provided, at portions thereof, with a low-expansion stainless steel.

FIG. 2 is a diagram illustrating materials constituting the shadow mask 2, support frame 3 and mask springs 4 in the shadow mask assembly 1 according to the embodiment shown in FIGS. 1*a* and 1*b* in comparison with the known materials constituting these members.

According to the shadow mask assembly 1 of this embodiment as shown in FIG. 2, the shadow mask 2 is made of invar (having a coefficient of thermal expansion of, for example, $6.89\times10^{-6}$) which is used for the conventional shadow mask, but the support frame 3 is made of a low-expansion stainless steel (having a coefficient of thermal expansion of, for example, $1.04\times10^{-5}$) instead of an aluminum-killed (AK) material of a low-carbon steel (having a coefficient of thermal expansion of, for example, $1.32\times10^{-5}$) which is used for the conventional support frame, and the mask springs 4 are made of a low expansion stainless steel (having a coefficient of thermal expansion of, for example, $1.19\times10^{-5}$) instead of a bimetal (stainless steel/invar) (the stainless steel having a coefficient of thermal expansion of, for example, $1.5\times10^{-5}$ and the invar having a coefficient of thermal expansion of, for example, $1.0\times10^{-6}$) which is used for the conventional mask springs.

In the shadow mask assembly 1 of this embodiment, furthermore, the support frame 3 and the mask springs 4 are about 20% thinner than the conventional support frame and mask springs owing to changes in the materials for the support frame 3 and the mask springs 4.

According to the shadow mask assembly 1 of this embodiment using such materials, the invar constituting the shadow mask 2 has a coefficient of thermal expansion ($6.89\times10^{-6}$) which is relatively close to a coefficient of thermal expansion ($1.04\times10^{-5}$) of the low-expansion stainless steel constituting the support frame 3. Therefore, the support frame 3 is not abnormally subjected to thermal expansion when it is welded to the shadow mask 2, and the curvature of the shadow mask 2 does not locally change after the support frame 3 cools. Therefore, a color picture tube provided with the shadow mask assembly 1 of this embodiment does not substantially suffer beam landing error due a change in the curvature of the shadow mask 2.

According to the shadow mask assembly 1 of this embodiment, furthermore, the low-expansion stainless steel constituting the support frame 3 has a coefficient of thermal expansion ($1.04\times10^{-5}$) which is very close to the coefficient of thermal expansion ($1.19\times10^{31\ 5}$) of the low-expansion stainless steel constituting the mask springs 4. In the color picture tube provided with the shadow mask assembly 1 of this embodiment, the expansion of the mask springs 4 with the rise in ambient temperature is very little, and thus the shadow mask assembly 1 does not excessively rotate. Therefore, the color picture tube employing the shadow mask assembly 1 of this embodiment makes it possible to considerably decrease the beam landing error due to an excess turn of the shadow mask assembly 1.

Figure 3:
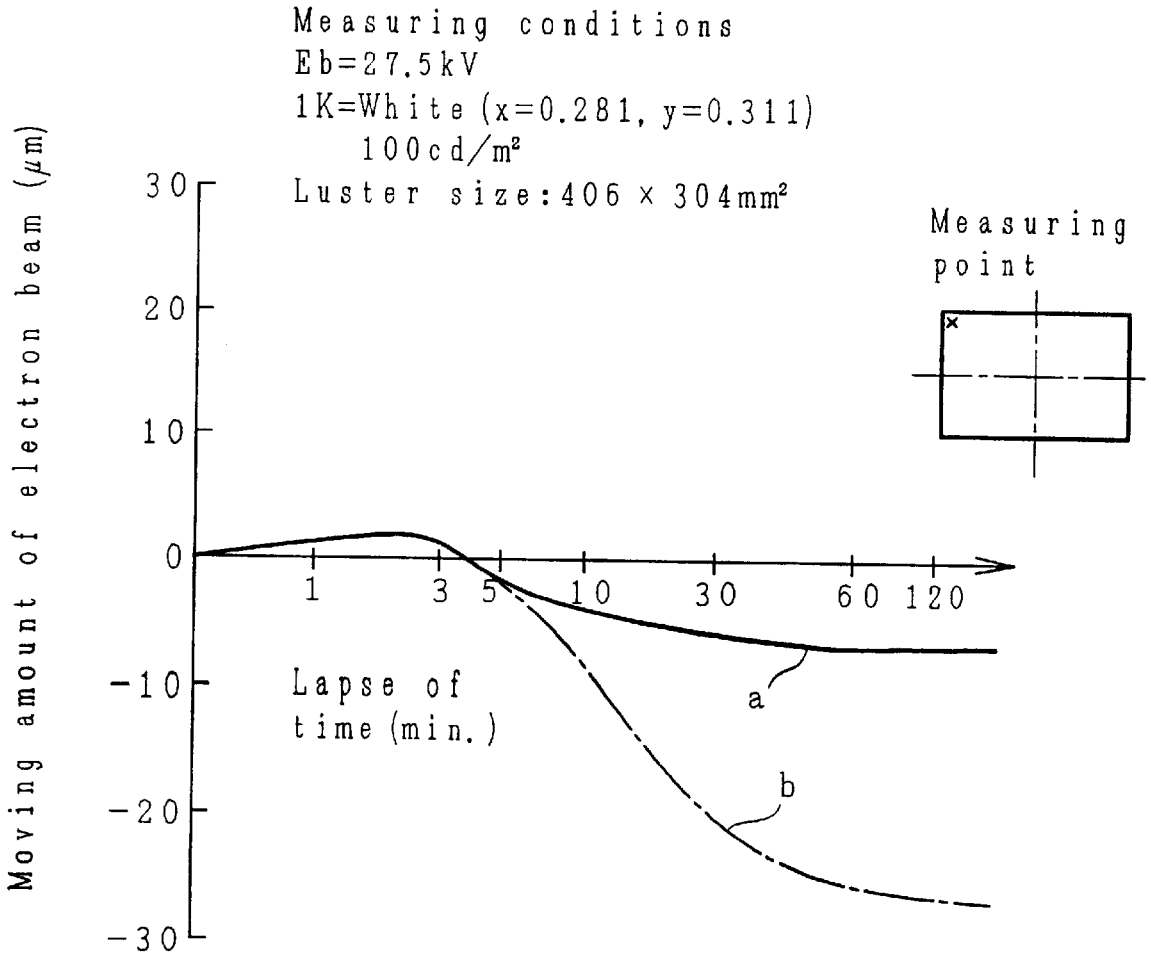
FIG. 3 is a diagram comparing purity drift characteristics of the present invention and the known shadow mask assembly.
Figure 4:
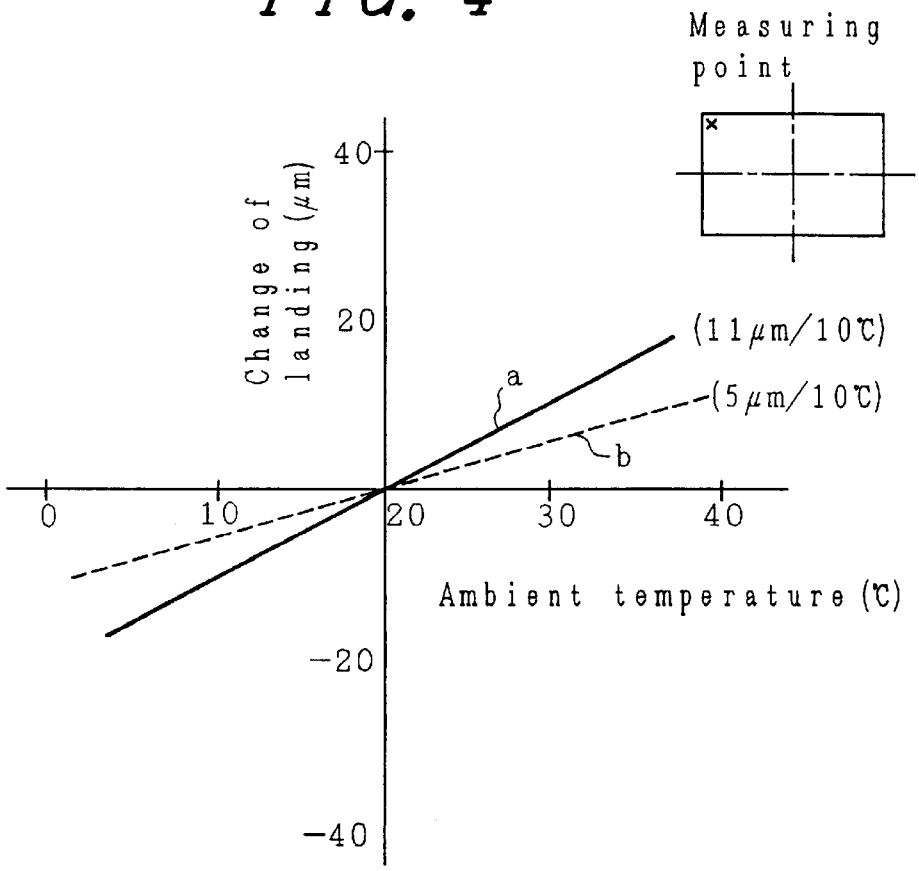
FIG. 4 is a diagram comparing environmental temperature characteristics of the present invention and the known shadow mask assembly.
Figure 5:
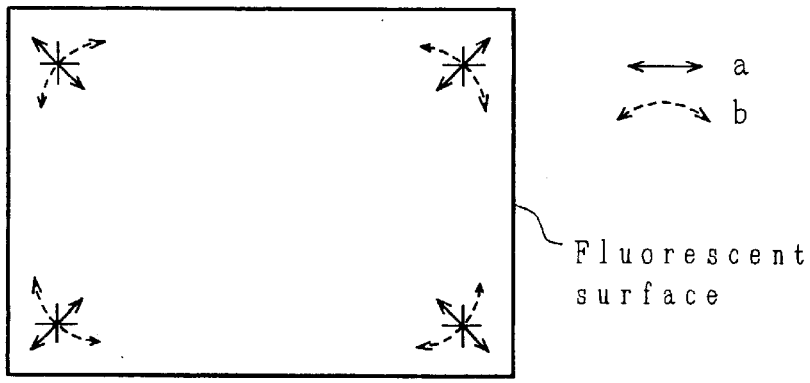
FIG. 5 is a diagram illustrating directions of beam landing errors in the shadow mask assembly of the present invention and the known shadow mask assembly.

FIGS. 3 to 5 are diagrams of characteristics illustrating improvement in the beam landing in the shadow mask assembly 1 of this embodiment, wherein FIG. 3 is a diagram illustrating purity drift characteristics, FIG. 4 is a diagram illustrating environment temperature characteristics, and FIG. 5 is a diagram illustrating the directions of occurrence of beam landing error. In all of these drawings, the characteristics are illustrated in comparison with those of a known shadow mask assembly.

In FIG. 3, the axis of ordinate represents the displacement of the electron beam in microns ($\mu$m), the axis of abscissa represents the passage of time in minutes (min), a curve (a) represents characteristics of the shadow mask assembly 1 of this embodiment, and a curve (b) represents characteristics of a known shadow mask assembly. Both curves are obtained under the same measuring conditions at panel corners of the color picture tube.

In FIG. 4, the axis of ordinate represents the change in the electron beam landing in microns ($\mu$m), the axis of abscissa represents the ambient temperature in centigrade (°C.), a solid line (a) represents characteristics of the shadow mask assembly 1 of this embodiment, and a dotted line (b) represents characteristics of a conventional shadow mask assembly.

Referring to FIG. 5, solid lines represent characteristics of the shadow mask assembly 1 of this embodiment, and dotted lines represent characteristics of the known shadow mask assembly.

Referring to FIG. 3, when the purity drift characteristics (curve a) of the shadow mask assembly 1 of this embodiment are compared with purity drift characteristics (curve b) of the known shadow mask assembly, the electron beams move on the same curve within five minutes. After five minutes, however, the displacement of the electron beam becomes considerably smaller in the purity drift characteristic (curve a) of the shadow mask assembly 1 of this embodiment than in the purity drift characteristic (curve b) of the known shadow mask assembly.

Referring to FIG. 4, furthermore, the amount of change in the electron beam landing (dotted line b) of the known shadow mask assembly has an inclination of 0.5 $\mu$m/°C. whereas the amount of change in the electron beam landing (solid line a) of the shadow mask assembly 1 of this embodiment has an inclination of 1 $\mu$m/°C. which is greater than twice that of line b. However, the influence of ambient temperature on the operating temperature of the color picture tube using the shadow mask assembly 1 of this embodiment is equivalent to that of the color picture tube using the known shadow mask assembly owing to improvements in the purity drift characteristics and improvements in the moving direction of electron beam landing that will be described later.

Referring to FIG. 5, furthermore, in the application to the fluorescent surface of the color picture tube, electron beam landing through the known shadow mask assembly deviates along an arc whereas the electron beam landing through the shadow mask assembly 1 of this embodiment deviates along a straight line, thus making it easy to adjust and correct electron beam landing error.

According to the present invention having the above-mentioned constitution, the support frame is not abnormally subjected to thermal expansion when the shadow mask is welded to the support frame, so that the curvature of the shadow mask does not change locally, thus preventing beam landing error.

According to the present invention having the above-mentioned constitution, furthermore, the shadow mask assembly does not turn excessively despite the rise in the ambient temperature of the shadow mask assembly making it possible to decrease the beam landing error caused by an excess of turn.

Second Embodiment

According to another embodiment, the shadow mask is made of a metal material composed chiefly of invar, and the support frame and the mask springs are made of metal materials having coefficients of thermal expansion of not larger than $1.19\times10^{-5}$.

In the first embodiment, low-expansion stainless steels used for the support frame 3 and the mask springs 4 are those having coefficients of thermal expansion of $1.04\times10^{-5}$ and $1.19\times10^{-5}$. In the present invention, however, the low-expansion stainless steel used for constituting the support frame 3 and the mask springs 4 is not limited to those examples, and the stainless steel may have a different coefficient of thermal expansion. Here, however, the low-expansion stainless steel used for the support frame 3 and for the mask springs 4 preferably has a coefficient of thermal expansion of not larger than $1.19\times10^{-5}$. When the low-expansion stainless steels used for the support frame 3 and the mask springs 4 have dissimilar coefficients of thermal expansion, furthermore, the difference in coefficient of thermal expansion between them should be within ±20%.

In the previous embodiments, low-expansion stainless steel is used for the materials constituting the support frame 3 and the mask springs 4. According to the present invention, however, the metal materials used for the support frame 3 and for the mask springs 4 are not limited to low-expansion stainless steel but may be other materials such as invar having coefficients of thermal expansion of not larger than $1.19\times10^{-5}$.

According to the present invention as described above, the shadow mask is constituted by a metal material composed chiefly of invar like the material constituting the known shadow mask, and the support frame and the mask springs are constituted by metal materials having coefficients of thermal expansion of not larger than $1.19\times10^{-5}$, different from the materials constituting the known support frame and the mask springs.

The aforementioned constitution makes it possible to obtain the same effects as those of the first embodiment.

Third Embodiment

According to a still further embodiment, the shadow mask is made of a metal material composed chiefly of invar, and the support frame and the mask springs are made of low-expansion stainless steel whose chromium content is 11% to 16% by weight, which is called chromium type stainless steel (Fe—Cr alloy). The chromium type stainless steel is given numerical designations between 400 and 500 by the American Iron and Steel Institute (AISI).

In the shadow mask assembly 1 of this embodiment, the shadow mask 2 is constituted by using invar which is the same material as the one constituting the conventional shadow mask, the support frame 3 is constituted by using a low-expansion stainless steel whose chromium content is 11% to 16% by weight, and the mask springs 4 are constituted by using a low expansion stainless steel whose chromium content is 11% to 16% by weight.

In the shadow mask assembly 1 of this embodiment constituted by using the above-mentioned materials, the coefficient of thermal expansion of invar constituting the shadow mask 2 is relatively close to the coefficient of thermal expansion of the low-expansion stainless steel constituting the support frame 3. Therefore, the support frame 3 is not abnormally subjected to thermal expansion when the shadow mask 2 is welded to the support frame 3. After the support frame 3 cools, the curvature of the shadow mask 2 does not change locally. Therefore, the color picture tube provided with the shadow mask assembly 1 of this embodiment does not substantially suffer beam landing error.

Moreover, this constitution makes it possible to obtain the same effects as those of the first embodiment.

Besides, the support frame and the mask springs made of low expansion stainless steels, containing chromium in a content of 11% to 16% by weight, exhibit improved magnetic permeability. In particular, the support frame having improved magnetic permeability requires lower electric power for demagnetization and provides improved margin against terrestrial magnetism.

Fourth Embodiment

According to another embodiment, the shadow mask is made of invar, and the support frame is made of a stainless steel whose Ni content is less than 10%. (Generally, stainless steel has a chromium content of more than 10 wt %.) This material has less thermal expansion than steel; in addition, it is suitable for press working to form the support frame because of limited Ni content. If the Ni content increases, the thermal expansion become smaller; however, the material become harder and become more difficult to make press work.

The spring of this embodiment is also made by stainless steel whose Ni content is less than 10 wt %. Alternatively, the spring can be made of chromium type stainless steel. As far as the support frame is made according to this example, the shadow mask is made of invar, and conventionally used springs can attain the purpose of this invention to a certain extent.

A more preferable embodiment is that:

(1) The shadow mask is made of invar.

(2) The support frame is made of stainless steel which has a chromium content of substantially 11 wt %, and the Ni content is substantially 0.0083 wt %. This content is very suitable for the support frame in view of thermal expansion and press working. Regarding other contents, carbon is limited to less than or equal to 0.011 wt %.

The same material as the support frame of this embodiment can be applied to the spring. Other springs mentioned before can also be applied for the combination of shadow mask and support frame of this embodiment.

What is claimed is:

1. A color picture tube comprising a shadow mask having a domed central apertured portion, a support frame for holding said shadow mask, and mask springs for holding said support frame inside a panel of the color picture tube, wherein said shadow mask is made of a metal material composed chiefly of invar, said support frame is made of stainless steel which has a nickel content of at most 10% by weight, and said mask springs are leaf springs.

2. A color picture tube according to claim 1, wherein said stainless steel for said support frame has a chromium content of 11–16% by weight.

3. A color picture tube according to claim 2, wherein a difference in coefficient of thermal expansion between that of said support frame and that of said mask springs is not larger than 20%.

4. A color picture tube according to claim 2, wherein said mask springs are made of stainless steel which has a nickel content of not larger than 10% by weight.

5. A color picture tube according to claim 2, wherein said mask springs are made of stainless steel which is 11 Cr type to 16 Cr type stainless steel.

6. A color picture tube according to claim 5, wherein said mask springs are made of a same material as said support frame.

7. A color picture tube according to claim 2, wherein at least one of said support frame and said mask springs is made of stainless steel which has a coefficient of thermal expansion not larger than $1.19\times10^{-5}$.

8. A color picture tube according to claim 1, wherein a difference in coefficient of thermal expansion between that of said support frame and that of said mask springs is not larger than 20%.

9. A color picture tube-according to claim 1, wherein said mask springs are made of stainless steel which has a nickel content of not larger than 10% by weight.

10. A color picture tube according to claim 1, wherein said mask springs are made of stainless steel which is 11 Cr type to 16 Cr type stainless steel.

11. A color picture tube according to claim 10, wherein said mask springs are made of a same material as said support frame.

12. A color picture tube according to claim 1, wherein at least one of said support frame and said mask springs is made of stainless steel which has coefficient of thermal expansion hot-larger than $1.19\times10^{-5}$.

13. A color picture tube comprising a shadow mask having a domed central apertured portion, a support frame for holding said shadow mask, and mask springs for holding said support frame inside a panel of the color picture tube, wherein said shadow mask is made of a metal material composed chiefly of invar, said support frame is made of chromium type stainless steel having a chromium content of 11–16% by weight, and said mask springs are leaf springs.

14. A color picture tube according to claim 13, wherein a difference in coefficient of thermal expansion between that of said support frame and that of said mask springs is not larger than 20%.

15. A color picture tube according to claim 13, wherein said mask springs are made of stainless steel which has a nickel content of not larger than 10% by weight.

16. A color picture tube according to claim 13, wherein said mask springs are made of stainless steel which is 11 Cr type to 16 Cr type stainless steel.

17. A color picture tube according to claim 16, wherein mask springs are made of a same material as that of said support frame.

18. A color picture tube according to claim 13, wherein at least one of said support frame and said mask springs is made of stainless steel which has a coefficient of thermal expansion not larger than $1.19\times10^{-5}$.

19. A color picture tube comprising a shadow mask having a domed central apertured portion, a support frame for holding said shadow mask, and mask springs for holding said support frame inside a panel of the color picture tube, wherein said shadow mask is made of a metal material composed chiefly of invar, said support frame is made of stainless steel which contains chromium in an amount of substantially 11% , by weight and nickel in an amount of not larger than 0.0083% by weight, and said mask springs are leaf springs.

20. A color picture tube according to claim 19, wherein mask springs are made of a same material as that of said support frame.

* * * * *